US005179994A

United States Patent [19]

Kuhn

[11] Patent Number: 5,179,994

[45] Date of Patent: Jan. 19, 1993

[54] METHOD OF ELIMINATING POROSITY DEFECTS WITHIN ALUMINUM CYLINDER BLOCKS HAVING CAST-IN-PLACE METALLURGICALLY BONDED CYLINDER LINERS

[75] Inventor: John W. Kuhn, Bristol, Ind.

[73] Assignee: CMI International, Inc., Southfield, Mich.

[21] Appl. No.: 821,229

[22] Filed: Jan. 16, 1992

[51] Int. Cl.[5] ..... B22D 19/00

[52] U.S. Cl. ..... 164/100; 164/69.1; 164/98

[58] Field of Search ..... 164/69.1, 91, 98, 100, 164/101, 102

[56] References Cited

U.S. PATENT DOCUMENTS

| | | | |
|---|---|---|---|
| 1,710,136 | 4/1929 | Angle et al. | 123/193 |
| 2,455,457 | 12/1948 | Whitfield et al. | 309/2 |
| 2,544,670 | 3/1951 | Grange | 164/102 |
| 2,881,491 | 4/1959 | Jominy | 164/102 |
| 3,069,209 | 12/1962 | Bauer | 309/3 |
| 3,149,383 | 9/1964 | Seyffer et al. | 164/100 |
| 3,165,983 | 1/1965 | Thomas . | |
| 3,276,082 | 10/1966 | Thomas | 22/204 |
| 3,480,465 | 11/1969 | Imabayashi | 164/91 |
| 3,856,635 | 12/1974 | Brown | 164/131 |
| 4,936,270 | 6/1990 | Ushio et al. | 123/193 C |
| 5,005,469 | 4/1991 | Ohta | 92/169.4 |

FOREIGN PATENT DOCUMENTS

| | | | |
|---|---|---|---|
| 0010369 | 1/1980 | Japan | 164/100 |
| 0151954 | 9/1983 | Japan | 164/98 |
| 0030466 | 2/1984 | Japan | 164/102 |
| 0081259 | 4/1987 | Japan | 164/98 |
| 0233055 | 9/1989 | Japan | 164/100 |

*Primary Examiner*—Richard K. Seidel
*Assistant Examiner*—James Miner
*Attorney, Agent, or Firm*—Reising, Ethington, Barnard, Perry & Milton

[57] ABSTRACT

A method for eliminating porosity defects in aluminum cylinder blocks (22) having cast-in-place metallurgically bonded cylinder liners (12) includes coating the liners (12) with a low melting point molten metal such as zinc and thereafter removing a virtually entire outer layer of pure Zn, which would otherwise melt during casting and invade the block metal, leaving behind shrinkage defects in the resultant cylinder block (22).

6 Claims, 1 Drawing Sheet

METHOD OF ELIMINATING POROSITY DEFECTS WITHIN ALUMINUM CYLINDER BLOCKS HAVING CAST-IN-PLACE METALLURGICALLY BONDED CYLINDER LINERS

BACKGROUND OF THE INVENTION

1. Field of the Invention

The present invention relates to a method for eliminating shrinkage or porosity defects in aluminum cylinder block castings having cast-in-place metallurgically bonded cylinder liners.

2. Description of the Related Prior Art

When producing an aluminum cylinder block for an automotive engine, it is often necessary to include cylinder liners made of high wear resistant materials in order to increase longevity of the cylinder block.

There are a number of different ways of securing the liners in the block. One way is to metallurgically bond the liners to the block. In this process, the liners are typically coated with a low melting point metal material, such as zinc-based metal, which is compatible with both the aluminum cylinder block material and the selected material (e.g., cast iron liners), such that the zinc coating is capable of alloying with each of these materials.

After the liners have been coated, they are disposed in a casting cavity of a cylinder block mold and molten aluminum is cast into the cavity and around the liners. The molten aluminum melts the coating on the liner and the coating then alloys with the liner and cylinder block materials. When the casting solidifies, the liner is thereby metallurgically bonded to the resultant cylinder block. Such a process is disclosed in the related U.S. Pat. Nos. 3,165,983, granted Jan. 19, 1965 and 3,276,082, granted Oct. 4, 1966, both in the name of Thomas.

In the case of a zinc-based coating, an outer surface layer develops which consists essentially of pure zinc material. On the one hand, this layer is beneficial since it provides a certain corrosion protection to the coated cylinder liners prior to casting. On the other hand, this layer can prove to be deleterious to the integrity of the finished casting since it produces porosity defects within the cylinder block during solidification of the casting. In particular, this outer layer melts during casting and infiltrates the aluminum cylinder block material. This phenomenon is particularly prevalent when casting the V-type cylinder blocks, where the liners inclined in the mold during casting since when the coating melts during casting, the dense essentially pure Zn layer of the coating is caused to pool along the downward most portion of bottom edge of the cylinder liners. When enough of this material collects along the edge, it drips off the liner and enters into the aluminum cylinder block material. This drip of coating material is denser than the aluminum cylinder block material and continues to journey into the cylinder block material.

Since the essentially pure zinc material also has a higher shrinkage rate than the surrounding aluminum cylinder block material, the progressing "drip" leaves behind a "worm-like" void or shrinkage defect within the resultant cylinder block. Such porosity defects are, of course, undesirable in high quality cylinder block castings.

SUMMARY OF THE INVENTION AND ADVANTAGES

A method of eliminating shrinking defects within aluminum cylinder block castings having metallurgically bonded cast-in-place cylinder liners includes first forming a cylinder liner and then metallurgically bonding a metal coating material to the liner. The coated liner is then disposed within a cavity of a cylinder block casting mold, after which molten aluminum cylinder block metal is cast into the cavity and around the coated liner. This causes the coating to melt and further alloy with the cylinder block material which, upon solidification, metallurgically bonds the liner to the resultant cylinder block.

The characterizing feature of the subject method is removing an outer layer of the coating on the liner prior to casting in order to remove material having a high shrinkage rate which would otherwise melt during casting and infiltrate the cylinder block material forming undesirable shrinkage defects within the resultant cylinder block upon solidification.

A major advantage of this process is that an aluminum cylinder block having cast-in-place cylinder liners can be produced without forming the undesirable porosity defects in the cylinder block casting.

Another advantage is that removing the outer essentially pure zinc layer of the coating does not inhibit the ability to form a metallurgical bond, but rather, serves to enhance metallurgical bonding by presenting a clean unadulterated surface of the coating to the aluminum cylinder block material during castings.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE DRAWINGS

Figures 1, 2, 3, 4:
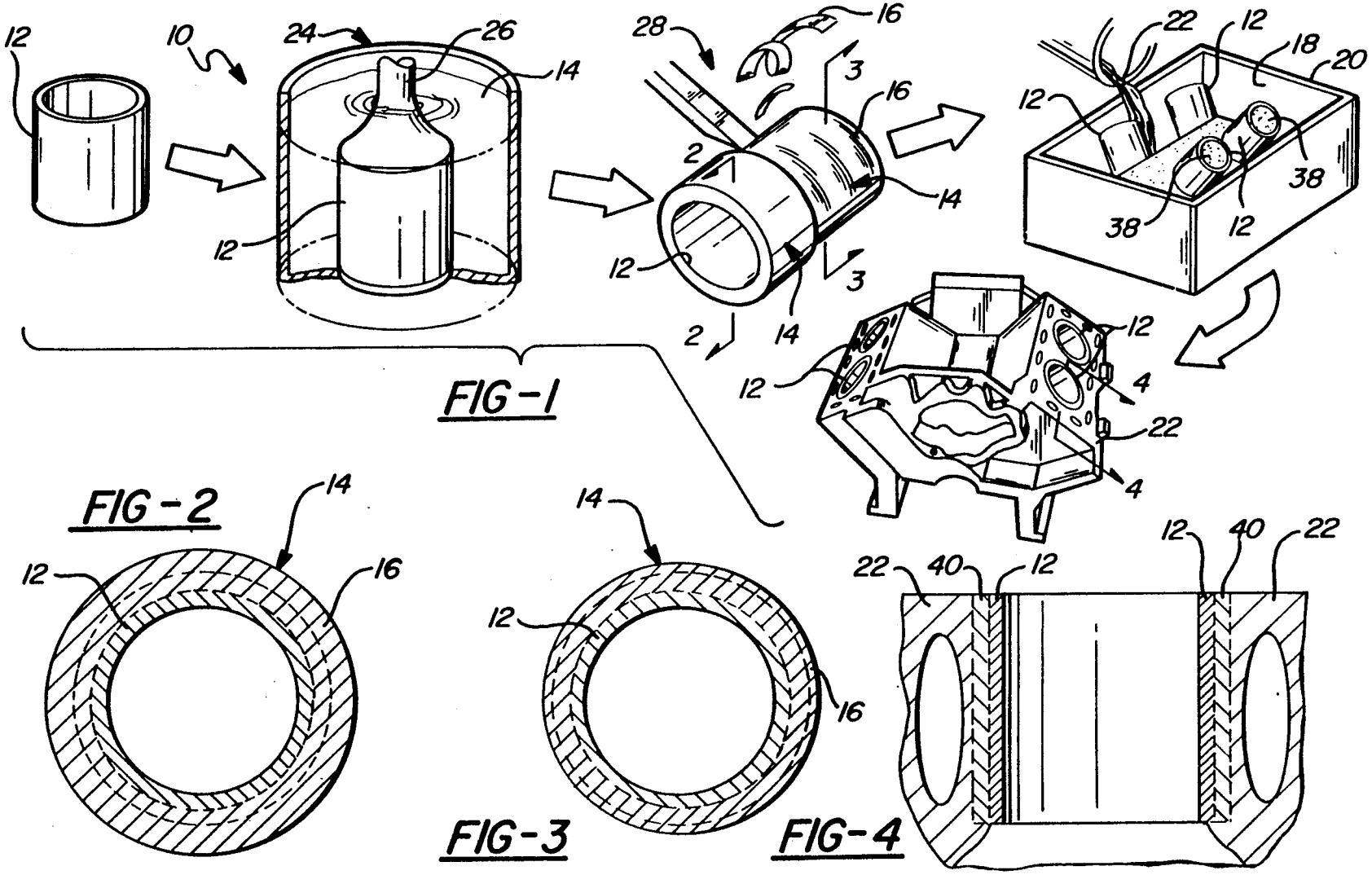
FIG. 1 is schematic flow diagram illustrating the method of the subject invention.
FIG. 2 is a cross-sectional view of the coated cylinder liner taken along lines 2—2 of FIG. 1.
FIG. 3 is a view like FIG. 2 but with a substantial portion of the essentially pure zinc outer layer of the coating removed.
FIG. 4 is a partial cross-sectional view of the cylinder block casting taken along lines 4—4 of FIG. 1 showing the liner metallurgically bonded to the cylinder block.

A flow diagram of the method of the subject invention is generally shown at 10 in FIG. 1 and briefly includes the steps of first forming a plurality of cylinder liners 12 and then coating the liners 12 with a low melting point metal coating material 14 in such a way that the coating material 14 metallurgically bonds to the outer surface of the liners 12. An outer layer portion 16 of the coatings 14 is then removed and the coated liners 12 disposed within a casting cavity 18 of a cylinder block mold 20. Molten aluminum cylinder block material 22 is then cast into the cavity 18 and around the coated liners 12. This causes the coating 14 on each liner 12 to remelt and further alloy with the aluminum cylinder block material 22. The casting is allowed to solidify, whereupon the liners 12 metallurgically bond to the resultant cylinder block 22 via the coating 14.

The liners 12 can be formed from any material exhibiting good wear resistant properties. The liners 12 shown in the Figures are cast from iron, but could also be made from other materials such as high silicon content aluminum alloys (e.g. 390 aluminum) as well as others. The number of liners 12 needed will, of course, correspond to the number of piston cylinders formed in the cylinder block 22. For instance, FIG. 1 illustrates a four cylinder V-type block 22 and thus requires four such cylinder liners 12.

The coating material selected should be one that readily alloys itself with both the liner and block metals. Zinc as well as tin and cadmium (or their alloys) have shown to be good coating materials 14 for the present embodiment.

A preferred method for applying the coating to the liners 12 includes securing the liners 12 in a suitable fixture 26 and then immersing the liners 12 in a bath of the molten zinc coating material 14 for a sufficient amount of time to allow the zinc coating material 14 to alloy with the exterior surface of the liners 12. Upon solidification, an alloyed phase of coating and liner metal is formed on the outer surface of the liner 12.

To promote good bonding between the liners 12 and the coating material 14 it may be necessary to clean the liners 12 prior to coating as well as preheating them.

After the liners 12 have been coated, they are withdrawn from the bath of molten coating material 14 and allowed to air dry until the coating 14 solidifies.

The coated liners 12 are then further treated at station 28 where a portion of the aforementioned outer layer 16 of each coating 14 is removed. The outer layer 16 comprises essentially pure base coating material 14, designated in FIGS. 2 and 3 as an outer most ring of coating material separated from the remaining coating material by a dotted line to indicate that it is a separate phase but still an integral part of the coating.

The zinc outer layer 16 has a lower melting point than the aluminum cylinder block material 22 but also has a higher shrinkage rate. It is believed that the porosity defects are caused by the denser outer layer material 16 invading the cylinder block material while both are in the molten state during casting, and then combining with (i.e., alloying) the cylinder block material 22 to form a localized zinc-aluminum pocket or region of material within the cylinder material 22 that has a higher shrinkage rate than the aluminum cylinder block material 22. Thus, when the casting solidifies, this localized zinc-aluminum pocket of material shrinks at a faster rate than the surrounding aluminum cylinder block material and forms the undesirable voids or porosity within the resultant cylinder block 22. It might also be possible that a certain portion of the essentially pure zinc material that enters the aluminum cylinder block material 22 during casting is not completely dissolved within the aluminum cylinder block material 22, but rather remains intact as a pocket of relatively more dense, higher shrinkage rate pure coating material within the cylinder block material 22 that continues to progress into the cylinder block material as the casting is solidifying, leaving behind a similar "worm-like" void or porosity defect within the resultant cylinder block 22.

Thus, although the coating on the liners 12 is essential to achieving a metallurgical bond between the liners 12 and the cylinder block 22, this outer layer of essentially pure zinc material 16 which develops during the coating process tends to produce undesirable porosity defects within the resultant cylinder block 22.

This porosity problem alluded to above is particularly prevalent when casting the V-type cylinder blocks, like the one depicted in the drawings. When casting a V-type cylinder block, the cylinder liners 12 are supported at an inclined angle within the cavity 18 of the cylinder block mold 20 to conform with the V-orientation characteristic of the V-type cylinder blocks. When the cylinder liners 12 are so oriented in the mold 20, the high zinc concentration outer layer material 16 (if not removed) is caused to pool or collect along the bottom edge of the cylinder liners 12, and then drip into the adjacent aluminum cylinder block material 22 during casting, resulting in the shrinkage defects described above. Thus, the inclination of the cylinder liner promotes concentration or agglomeration of the outer layer material 16 in the downward most situated region of the lower edge of the liner 12, thereby enhancing the likelihood that the outer layer material 16 will enter into the cylinder block material 22 and cause a formation of undesirable porosity defects.

In an effort to eliminate this porosity problem, it was discovered that by removing all but a small portion of the essentially pure zinc outer layer 16, the porosity problem was eliminated. However, it was also recognized that a certain amount of this essentially pure outer zinc layer 16 had to remain on the liners 22 for providing corrosion protection to the liners 12 prior to casting and developing good metallurgical bonding between the liners 12 and cylinder block 22. A 0.50 to 1.0 mill thickness of has been shown to be sufficient for providing the needed corrosion protection while at the same time eliminating the occurrence of porosity or shrinkage defects within the cast cylinder block 22.

A cross-sectional view of the cylinder liner having all but about 0.50 to 1.0 mill thickness of the essentially pure zinc outer layer 16 removed is shown in FIG. 3. The preferred method for removing the outer layer portion 16 of the coating 14 is by a mechanical machining operation, schematically illustrated at station 34 in FIG. 1. Machining the coated liners 12 also removes any oxides or impurities which may have formed on the outer surface of the coated liners 12 during coating. By machining the coated liners 12, a clean, unadulterated surface of the coating is exposed to the cylinder block material 22 during casting. The removal of these oxides and impurities promotes better alloying between the coating material 14 and the cylinder block material 22 during casting, and thus results in a better metallurgical bond between the liners 12 and the cylinder block 22.

Once the coated liners 12 have had the excess outer layer portion 16 of the coating 14 removed, the liners 12 are disposed in the cavity 18 of the cylinder block mold 20 on mandrels 38, as shown at station 36 in FIG. 1, and may further be inclined for forming the V-type cylinder block 22.

After the coated liners 12 have been positioned within the mold 20, the molten aluminum cylinder block material 22 is cast into the cavity 18 and surrounds the coated liners 12.

The molten aluminum cylinder block material 22 remelts the coating 14 which then alloys with the cylinder block material 22 to form a new material different from either the original coating material 14 or the cylinder block material 22. Upon solidification of the casting, this new material will take the form of a metallurgically bonded region 40 lying between and metallurgically bonded to the liners 12 and the cylinder block 22, as shown in FIG. 4. This metallurgically bonded region 40 is designated by dotted lines to indicate that there is no definite interface separating this region 40 from either the liner 12 or cylinder block 22, but rather that there has been a chemical intermixing between the coating material 14, the liner material 12 and the cylinder block material 22 to form a metallurgically bonded region 40. Thus, the bonded region 40 will comprise an alloy made up of a combination of the coating material (such as zinc), the liner material (such as iron) and the aluminum cylinder block material 22.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims the invention may be practiced otherwise than as specifically described.

What is claimed is:

1. A method of eliminating shrinkage defects within aluminum cylinder block castings having metallurgically bonded cast-in-cast place cylinder liners, said method comprising the steps of;

forming a metal cylinder liner (12);

metallurgically bonding a zinc-based metal coating material (14) to the liner (12) forming an alloyed layer of coating and liner metal adjacent the liner and an outer layer of essentially pure zinc coating material;

depositing the coated liner (12) within a cavity (18) of a cylinder block casting mold (20);

casting molten aluminum cylinder block metal (22) into the cavity (18) and around the coated liner (12) causing the coating (14) to melt and further alloy with the cylinder block metal (22) and allowing the cylinder block metal (22) to solidify and metallurgically bond with the liner (12);

and removing a sufficient amount of the outer coating layer prior to casting which would otherwise melt during casting and infiltrate the cylinder block metal (22) forming undesirable shrinkage defects within the resultant block (22) upon solidification while maintaining a remaining portion of such outer layer material intact to provide corrosion protection to the liner prior to casting.

2. A method as set forth in claim 1 further characterized by machining the liner to remove the essentially pure zinc outer layer portion (16) of the coating (14).

3. A method as set forth in claim 1 further characterized by metallurgically bonding the zinc-based coating material (14) to the liner (12) by first heating the coating material (14) to a molten state and thereafter submerging the liner (12) into the molten zinc-based coating material (14) to allow the coating material (14) to diffuse into and metallurgically bond with the liner (12).

4. A method as set forth in claim 1 further characterized by supporting the coated liner (12) non-vertically within the mold (20).

5. A method as set forth in claim 1 further characterized by forming the cylinder liner (12) of cast iron metal.

6. A method as set forth in claim 1 further characterized by removing all but about 0.5 to 1.0 mill layer thickness of the essentially pure zinc outer layer portion (16) in order to eliminate the shrinkage defects while still providing adequate corrosion protection to the liner (12).

* * * * *